United States Patent [19]

Koerner

[11] Patent Number: 4,610,568

[45] Date of Patent: Sep. 9, 1986

[54] SLOPE STABILIZATION SYSTEM AND METHOD

[76] Inventor: Robert M. Koerner, 533 E. Springfield Rd., Springfield, Pa. 19064

[21] Appl. No.: 594,365

[22] Filed: Mar. 28, 1984

[51] Int. Cl.[4] ..... E02D 17/20

[52] U.S. Cl. ..... 405/19; 405/15; 405/258

[58] Field of Search ..... 405/15, 17, 18, 270, 405/258, 262

[56] References Cited

U.S. PATENT DOCUMENTS

| | | | |
|---|---|---|---|
| Re. 28,977 | 9/1976 | Mason | 405/287 |
| 360,225 | 3/1887 | Kanters | 405/19 |
| 953,051 | 3/1910 | De Muralts | 405/16 |
| 984,121 | 2/1911 | Condie | 405/18 |
| 1,026,616 | 5/1912 | Stratton | 405/16 |
| 1,363,691 | 12/1920 | Sullivan | 405/19 |
| 2,143,461 | 1/1939 | Waring | 405/19 X |
| 2,315,351 | 3/1943 | Schaefer . | |
| 3,315,408 | 4/1967 | Fisher | 405/16 X |
| 3,474,626 | 10/1969 | Colle | 405/18 |
| 3,570,254 | 3/1971 | Turzillo | 405/18 |
| 3,653,167 | 4/1972 | Menard | 52/162 |
| 3,854,292 | 12/1974 | Nienstadt | 405/270 |
| 3,898,844 | 8/1975 | Menard . | |
| 4,056,936 | 11/1977 | Mayer . | |
| 4,329,089 | 5/1982 | Hilfiker et al. | 405/262 |
| 4,353,946 | 10/1982 | Bowers | 428/109 |
| 4,413,928 | 11/1983 | Tucker | 405/260 |

FOREIGN PATENT DOCUMENTS

| | | | |
|---|---|---|---|
| 295084 | 6/1963 | Australia . | |
| 473840 | 1/1915 | France . | |
| 1131333 | 2/1957 | France . | |
| 2217970 | 9/1974 | France . | |
| 45-28869 | 9/1970 | Japan . | |
| 0016731 | 2/1981 | Japan | 405/15 |
| 69537 | 9/1951 | Netherlands . | |
| 7011473 | 8/1971 | Netherlands . | |

*Primary Examiner*—Dennis L. Taylor

*Attorney, Agent, or Firm*—Benasutti and Murray

[57] ABSTRACT

A system and method for slope stabilization applicable to a wide range of slopes comprised of a variety of soils. A layer of geosynthetic fabric is deployed upon the surface of the slope to be stabilized and is anchored to the stable earth region which underlies the potential slip zone of the slope. The system actively maintains the potential slip zone between the geofabric layer and the underlying stable earth region.

20 Claims, 7 Drawing Figures

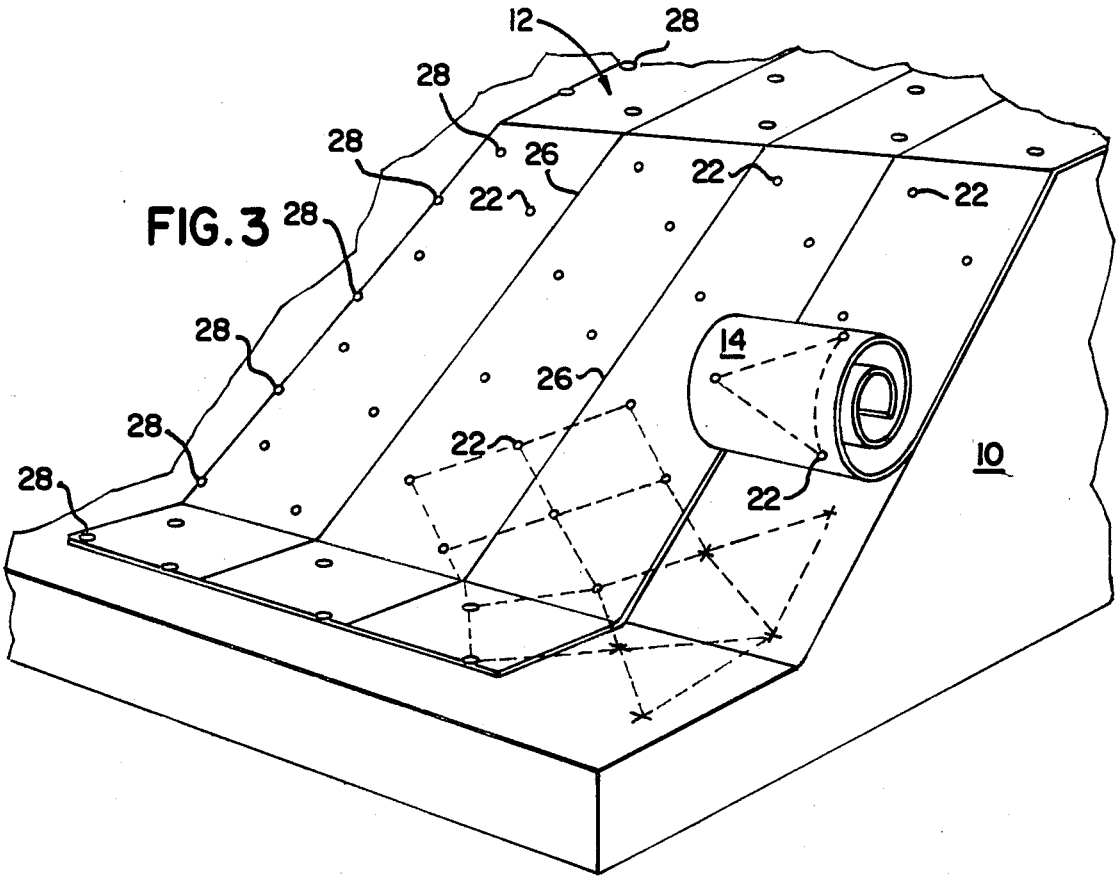
FIG. 3
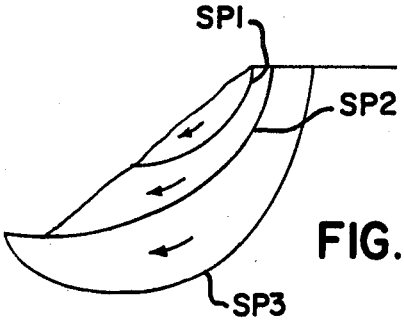
FIG. 7
FIG. 2
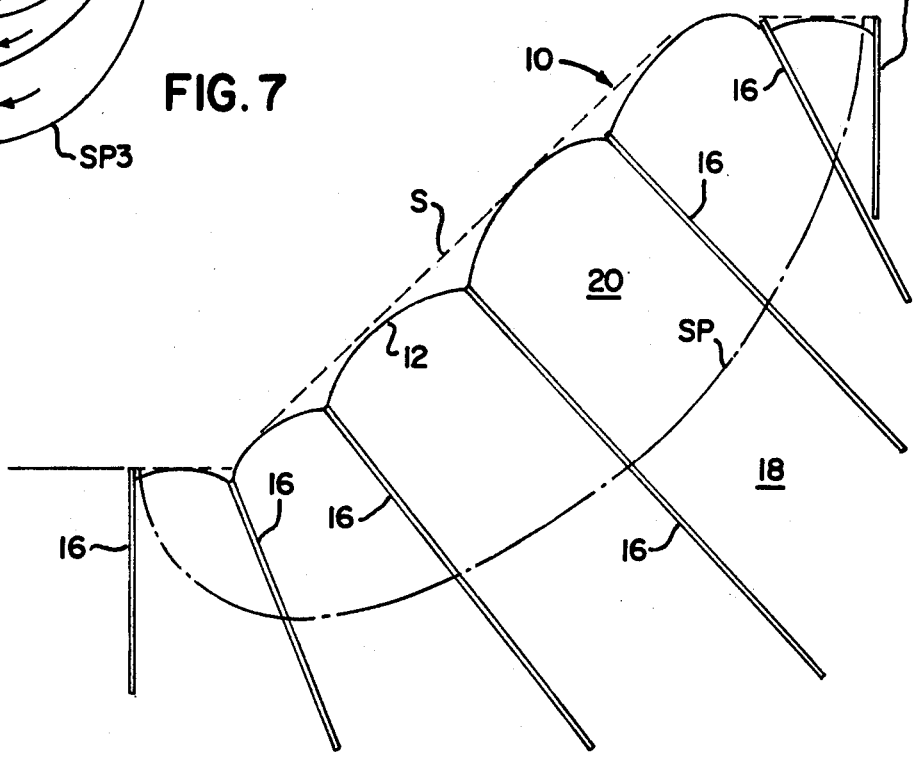

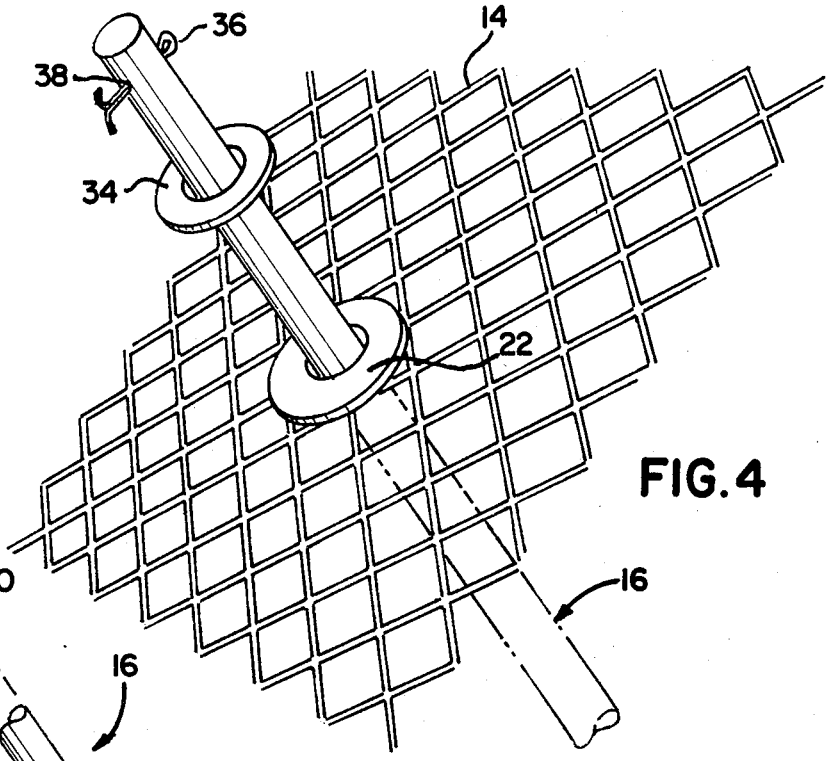
FIG. 4
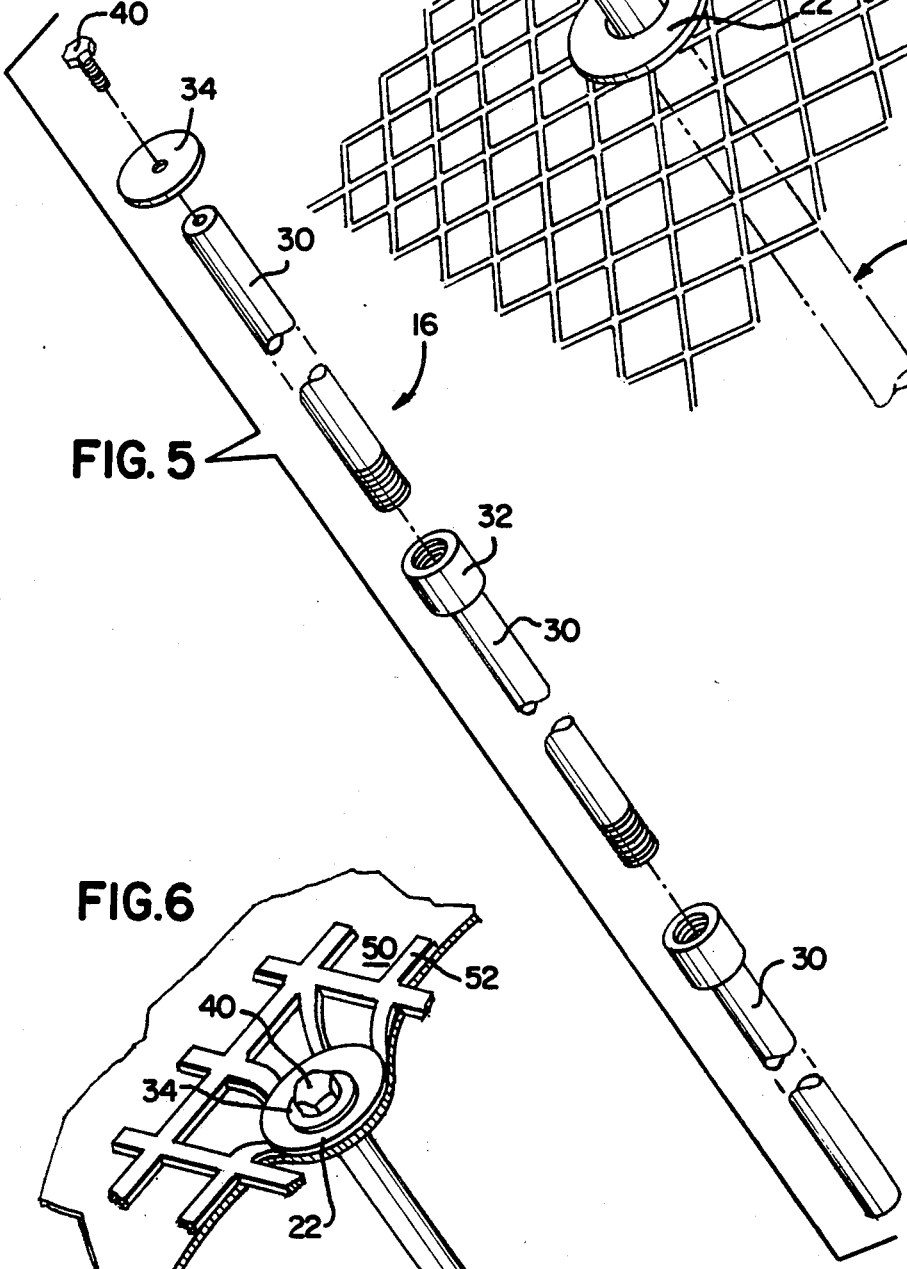
FIG. 5
FIG. 6
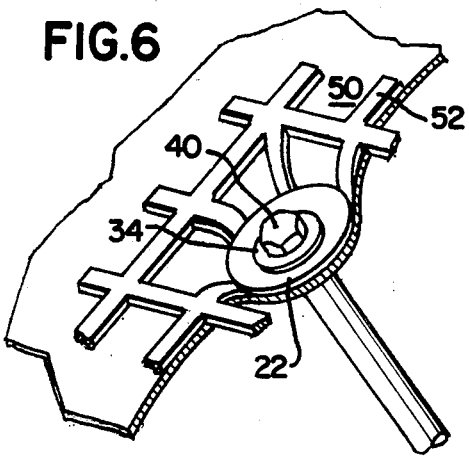

SLOPE STABILIZATION SYSTEM AND METHOD

BACKGROUND OF THE INVENTION

The present invention relates to a system and method for stabilizing the potential slip zone of a slope, and, in particular, to the use of anchored geosynthetic fabrics for effecting slope stabilization.

The problem of soil slope stability is of major importance in almost every part of the world. A variety of natural forces contribute to the deterioration of soil slopes which can result in land slides, mud slides or other slope failures. Slopes comprising granular soils such as gravels, sands and cohesionless silts, are subject to erosion which progressively steepens slope angles until instability occurs. Slopes comprised of fine grained soils, such as silts and clays, often suffer from long term creep movement and stability gradually decreases.

Conventional methods for stabilizing slopes comprise the construction of a retaining wall or a retaining structure, such as shown in U.S. Pat. No. 2,315,351 to Schaefer, to prevent soil displacement. The construction of walls or other rigid or semi-rigid structural barriers is often a very expensive and time consuming undertaking.

Another method for stabilizing slopes is taught in U.S. Pat. No. 3,989,844 to Menard. That patent teaches driving anchors into an embankment and thereafter attaching concrete plates via rods or connecting chains to the anchors to stabilize the embankment. Such a system is also relatively expensive and time consuming.

Geosynthetics are durable, permeable fabrics which are generally classified as either geotextiles or geogrids. Geotextiles, commonly known as construction fabrics or filter fabrics, are made from a variety of synthetic materials such as polypropolene, polyester, nylon, polyvinyl-chloride and polyethylene. They may be woven using monofilament yarns or slit film, or non-woven needled, heat set, or resin bonded fabrics. Geotextiles are available commercially from numerous manufacturers in the United States. Geogrids, also known as geogrid netting, are extruded polyethylene grids with square or rectangular openings from ¼ to 2 inches wide. Geogrids are distributed in the United States by the Tensar Corporation, Morrow, Ga.

Geosynthetic fabrics, such as geotextiles and geogrids, are used in a variety of both subterranean and surface uses. Some geotextiles are used in road construction to separate a bed of gravel or other material from the underlying earth.

Australian Pat. No. 295,084 discloses the use of geosynthetics to stabilize surface soil. The fabric is staked to the unprotected ground surface which inhibits erosion while grass or other vegetation roots. Such systems, however, do not address the problems associated with major slope failures.

SUMMARY AND OBJECT OF THE INVENTION

The present invention provides a system and method for slope stabilization having application to a wide range of slopes comprised of a variety of soils. A geosynthetic is deployed upon the surface of the slope to be stabilized and is anchored to the stable earth region which underlies the potential slip zone of the slope.

The geosynthetic is selected in accordance with soil conditions and slope stability. Preinstalled grommets at regular intervals in the geosynthetic define the fabric's anchoring points. The surface of the slope is covered with a layer of the fabric and, at each grommet location, an anchoring rod is driven through the potential slip zone of the slope and embedded in the underlying stable earth region. As the anchoring rods are driven to their final depth, the ends of the anchoring rods engage the grommets of the fabric and force the fabric against the slope surface. The tensioning of the fabric by the anchors serves to compress the soil within the potential slip zone of the slope between the fabric layer and the underlying stable earth region. Accordingly, the anchored fabric system actively acts to maintain the stability of the potential slip zone of the slope.

It is the object of the present invention to provide a relatively low cost, rapidly deployable system and method for slope stabilization.

It is a further object of the present invention to provide a system and method of slope stabilization which employs anchored fabric material to actively stabilize the potential slip zone of a slope.

Other objects and advantages of the present invention will become apparent from the following portion of the specification and from the accompanying drawings which illustrate, in accordance with the mandate of patent statutes, a presently preferred embodiment incorporating the principles of the invention.

BRIEF DESCRIPTION OF THE DRAWINGS

FIG. 2 is a cross-section of the fully deployed slope retaining system shown in FIG. 1;

FIG. 3 is a partial, perspective and elevational view of an alternate embodiment of a slope retaining system being deployed in accordance with the teachings of the present invention;

FIG. 4 is a partial, elevational view of a geosynthetic fabric and an associated anchoring rod for a retaining system constructed in accordance with the teachings of the present invention;

FIG. 5 is an exploded view of an alternate embodiment of an anchoring fixity for the slope retaining system;

FIG. 6 is a partial, elevational view of another alternate embodiment of a retaining system made in accordance with the teachings of the present invention; and FIG. 7 is a schematic diagram illustrating various types of potential slope failure.

DETAILED DESCRIPTION OF A PREFERRED EMBODIMENT

Figure 1:
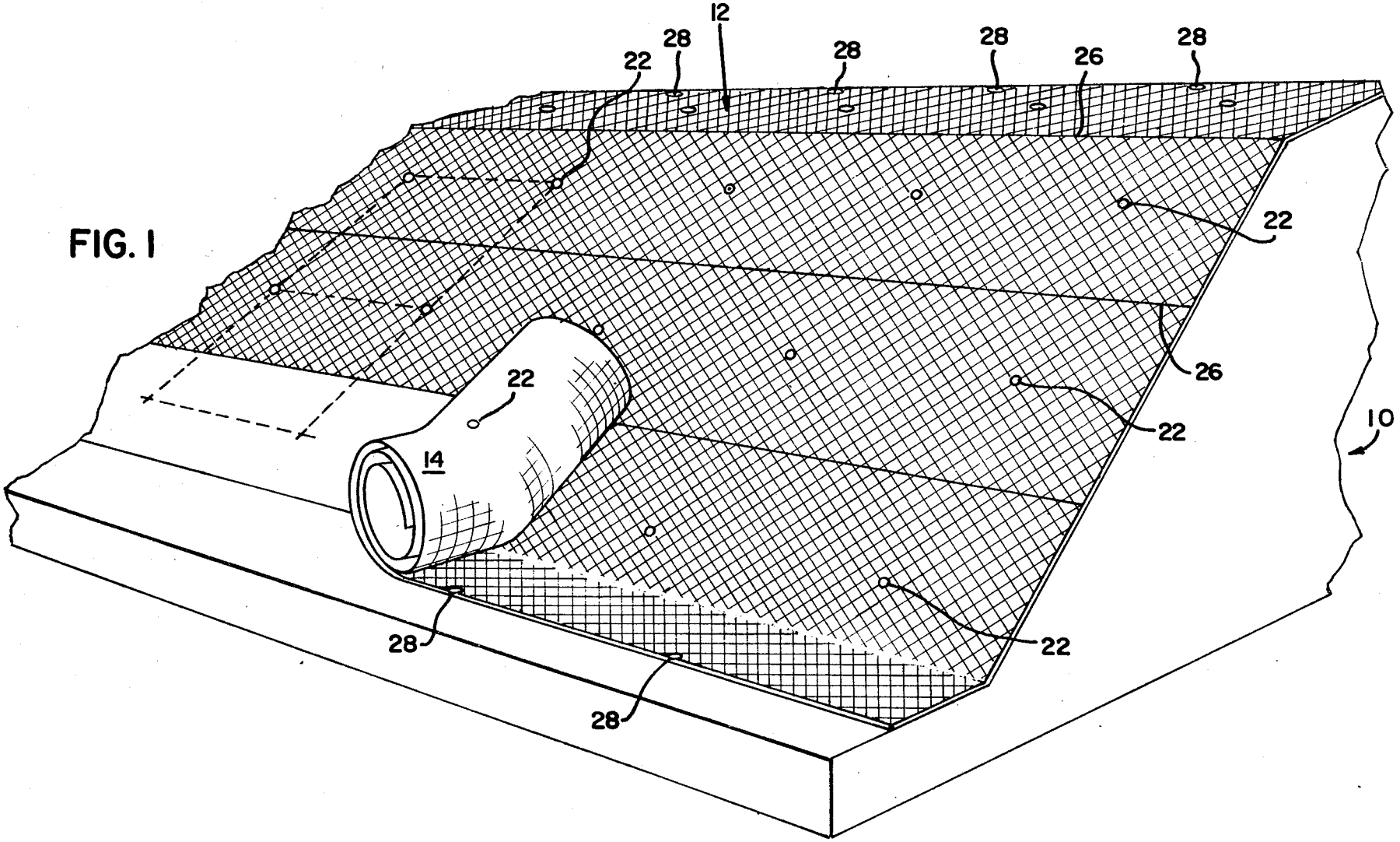
FIG. 1 is a partial perspective view of a slope stabilization system being deployed in accordance with the teachings of the present invention.

Referring to FIGS. 1 and 2, a slope 10 to be stabilized is covered with a layer 12 of geosynthetic fabric material 14. Anchoring rods 16 are driven through the fabric material at predetermined intervals to anchor the layer of fabric to the stable earth region 18 which underlies the potential slip zone 20 of the slope 10. As the anchors 16 are driven into the slope, the ends of the anchors 16 engage the layer of fabric 12 forcing it against the slope surface. As shown in FIG. 2, the tensioning of the fabric via the anchors 16 compacts the soil and compresses the potential slip zone 20 of the slope 10 between the fabric 12 and the underlying stable earth region 18. The original surface line S of the slope 10, before installation of the stabilizing system, and the shear plane SP of the slopes are shown in phantom.

The geosynthetic fabric 14 employed may be a geogrid (FIG. 1), a geotextile (FIG. 3), or a combination of both (FIG. 6). The selection of fabric 14 for a particular application is a function of slope stability, soil composition, and desired life of the system. The spacing and size of the anchors 16 are also dependent upon a variety of site conditions. The selection of the particular fabric, anchor spacing and anchor size are discussed in more detail below.

Typically, geosynthetic fabrics are available in rolls of standard widths. In the preferred embodiment, after slope conditions have been analyzed and selection of the type of fabric and size and spacing of the anchors has been made, grommets 22 are installed at regular intervals along the length of the fabric 14 in accordance with the anchor spacing requirements.

Preferably, the diameter of the grommet opening is approximately 0.25 inches greater than the diameter of the anchoring rods 16 which are to be used. When geogrid material is employed, the grommets 22 should be of sufficient size to entirely fill the geogrid interstice at which they are installed so that the anchoring stresses are evenly distributed. In any event, the grommets preferably have a generous amount of metal overlap with the fabric to avoid stress concentrations. Sawtooth type grommets which are used for heavy tent materials are preferred.

In preparing for the installation of the system, the slope 10 is rough graded to eliminate abrupt high spots and to fill in sharp holes and depression. Then, as shown in FIG. 1, lengths of fabric 14 having the grommets 22 previously installed are unrolled across the slope from the upper levels downwardly until the entire slope is covered. Alternatively, the lengths of geofabric 14 can be unrolled from the top of the slope 10 downwardly as illustrated in FIG. 3. If wind is problematic or if installation is underwater, large nails or staples, 6 to 12 inches in length, may be employed to temporarily maintain the positioning of the geofabric 14 duirng installation of the system.

The lengths of fabric 14 are seamed together by sewing or stapling the adjacent fabric together. The strength of the seams 26 is at least 90% of the tensile strength of the unseamed fabric. To avoid undue stress upon the seams, the grommets 22 are preferably located at a substantial spacing from the selvage of the fabric material 14 and at regular intervals, such that when the lengths of fabric are laid side by side to cover the slope, a grid of uniformly spaced anchoring points is formed.

For example, if the fabric width is 10 feet and the desired anchor spacing is 10 feet, grommets 22 are located at intervals of 10 feet along the center of the lengths of fabric 14. As illustrated in FIG. 1, a square grid of grommets spaced 10 feet apart is then created when the fabric is deployed on the slope. Alternatively, if the fabric width is 20 feet and the desired anchor spacing is approximately 15 feet, the grommets are installed in two stagged rows, 5 feet from the respective edges of the geofabric at intervals of 20 feet in each row. As depicted in FIG. 3, a diamond-shaped pattern of uniformly spaced grommets 22 results when the geofabric is deployed on the slope 10. In such instance, the spacing between adjacent grommets is 14.14 feet.

Preferably, in addition to the grommets 22 located on the interior of the fabric, grommets 28 are also installed along the top and bottom edges (FIG. 1) or extreme side edges (FIG. 3) of the slope-covering layer 12 of fabric material to facilitate the anchoring of the edges of the geosynthetic fabric layer to the slope.

Starting with the top edge of the fabric layer 12, and working down the slope 10, the anchor rods 16 are driven into the slope 75% to 90% of their intended depth at each grommet (FIG. 4). If the anchor 16 is relatively short, a single piece of pipe or metal rod is used. For longer anchors, several pipe or rod segments 30 are driven into the slope on top of each other; successive segments 30 being coupled by threaded connectors 32 or the like (FIG. 5) as they are installed.

Each anchor 16 is then coupled to the fabric. As best seen in FIG. 4, the anchor coupling comprises a washer 34 which is placed over the end of the anchor 16 and retained thereon via a cotter pin 36 inserted through a hole 38 in the anchor's end. Alternatively, the washer 34 may be retained by a bolt 40 threaded into the end of the anchor (FIG. 5).

Starting at the top of the slope 10, the anchor rods 16 are then driven to 95% of their final depth which causes the washers 34 to engage the grommets 22, 26 thereby tensioning the fabric against the slope surface. Each anchor is driven to its final depth (FIG. 6), whereat the fabric is tensioned to between 50% to 75% of its tensile strength, after all the adjacent anchors have been driven to the 95% depth level.

The process continues in a uniform fashion until all the anchors 16 are completely installed. This results in uniformly compressing the potential slip zone 20 of the slope 10 between the geofabric 12 and the stable earth region 18.

Where the potential slip zone of the slope comprises granular soils, compaction and subsequent densification of the soil occurs as the fabric layer is anchored; where the potential slip zone comprises cohesive soils, the soil is consolidated during the anchoring process.

Growth of vegetation through the geofabric layer 12 is advantageous for the long term stabilization of the slope. When geotextiles are employed for the geofabric, the slope is seeded for appropriate ground cover vegetation before the placement of the geofabric on the slope; when geogrids are employed, seeding may be done after installation of the anchored geofabric system.

Over time, the tensioned geofabric 12 may become relaxed for various reasons. In the case of granular soils, compaction along with some possible erosion may occur due to extreme weather conditions. In the case of cohesive soils, the anchored geofabric acts to consolidate the soil causing pore water pressure in the water in the soils voids. Eventually the water escapes thereby causing the tensioning of the geosynthetic fabric to become relaxed. Accordingly, the anchored fabric system is maintained through periodically checking the tensioning of the geofabric. Restressing of the fabric is then effected where the geofabric has become relaxed by driving the anchoring rods 16 further into the ground.

SELECTION OF THE GEOFABRIC

The selection of the geosynthetic fabric material 14 which is used for a particular application is based upon site conditions and the desired permanency of the system. The fabric should have a weight of at least 4.0 oz./sq. yd. and a tensile strength of at least 100 pounds per inch width as measured by the grab strength test ASTM B 1682.

TABLE 1

| General Slope Stability | Fabric Tensile Strength (pounds per inch width) Approx. Anchor Spacing 5' | 10' | 15' | 20' |
|---|---|---|---|---|
| questionable | 100 | 133 | 167 | 200 |
| marginable | 133 | 178 | 222 | 267 |
| poor | 167 | 222 | 278 | 333 |
| very poor | 200 | 267 | 333 | 400 |

A determination of slope stability is based upon factors such as slope height, slope angle, soil type, moisture conditions and type of slope failure. Slope stability is discussed in more detail below in conjunction with anchoring point spacing.

Generally, geogrids are employed where the tensile strength requirement is relatively high and geotextiles are employed where the tensile strength requirement is relatively low.

As noted above, permanance of installation also plays a role in fabric selection. For temporary stabilization, less than one year or until vegetation of the slope germinates and begins to grow, most commercially available geotextiles are adequate as would be natural materials such as cotton. For intermediate stabilization times, up to five years, geotextiles or geogrids which are UV stabilized are employed since most nonstabilized synthetic polymers break down after extended periods of exposure of ultraviolet (UV) light. One method of UV stabilization is the addition of carbon black into the polymer when it is formed. For permanent stabilization high density polyethylene goegrids or geogrid-like material are recommended.

Whatever the geosynthetic fabric employed, the size of the fabric's interstices become a factor in the selection process. Interstice size is a function of soil type.

For granular soils, i.e., gravels, sands and cohesionless silts, 95% of the size of interstices of the fabric is not greater then twice the particle size where 85% of the granular soil is finer and not greater than five times the particle size where 15% of the granular soil is finer, as set forth in the following equation:

$$O_{95} \leqq 2d_{85} \text{ and}$$

$$O_{95} \leqq 5d_{15}$$

where $O_{95}$=95% of interstice size of the geosynthetic $d_{85}$=particle size where 85% of the soil is finer $d_{15}$=particle size where 15% of the soil is finer For cohesive soils, i.e., clayey silt, silty clays, clays and mixtures with clays present, the maximum values for 95% of the size of the fabric interstices ($O_{95}$) are set forth in Table 2.

TABLE 2

| Consistency of Soil | Unconfined Compression Strength | Maximum Value of $O_{95}$ of Netting |
|---|---|---|
| soft | 0–10 psi | 0.15 mm |
| medium | 10–50 psi | 0.25 mm |
| hard | 50–100 psi | 0.84 mm |

As shown in FIG. 6, a layer of goetextile 50 may be employed beneath geogrid netting 52 as an alternative to choosing a geogrid material having selectively sized interstices.

ANCHORING SPACING AND SIZE

Anchor spacing depends upon several factors which are used in determining the general state of stability of the slope, such as slope angle, slope height, slope regularity, soil type, soil moisture content, seepage conditions, and erosion conditions. In general, the spacing will range from 5 to 20 feet between adjacent anchors in either a square or diamond pattern as illustrated in FIGS. 1 and 3 respectively.

Table 3 provides typical anchor spacing requirements.

TABLE 3

| General Slope Stability | Typical Slope Angle | Typical Slope Height | Typical Anchor Spacing |
|---|---|---|---|
| questionable | 30°–45° | 0–10' | ≅20' |
| marginal | 40°–55° | 7'–15' | ≅15' |
| poor | 45°–60° | 12'–20' | ≅10' |
| very poor | >60° | >18' | ≅5' |

The anchors 16 will generally be metal pipes or rods which are either continuous in their length or in sections which are coupled together as they are being driven, as discussed above. Typically they will be steel, galvanized or wrought iron pipes threaded on their ends to be coupled together by pipe couplings 32 (FIG. 5), or smooth or deformed reinforcing rods which are threaded on their ends for pipe couplings or welded together. The option exists to prefabricate smooth rod sections with a machined male thread on one end and a machined female thread on the other. When installed in sections, this procedure leaves a smooth outer surface on the anchor 16.

The length of the anchor rods is critical to the functioning of the system. The anchors 16 must intersect the potential shear plane SP and extend well beyond it into stable soil 18 as shown in FIG. 2. The anchor length varies according to the type of potential failure, the slope angle, slope height, soil type, anchor spacing, and general site conditions.

FIG. 7 illustrates the approximate relative location of the potential shear plane for the three general classes of soil failure: line SP1 indicating the shear plane for slope failure; line SP2 the shear plane for toe failure; line SP3 the shear plane for base failure. The probably type of failure for a particular slope is determined by conventional geotechnical slope analysis based upon Soil Mechanics principles. Table 4 provides guidelines for anchor length selection accordingly.

TABLE 4

| Slope Angle | Slope Height | Average Anchor Length for Prevention of Various Failures: Slope Failure | Toe Failure | Base Failure |
|---|---|---|---|---|
| 35° | 10' | 4' | 6' | 10' |
| | 20' | 6' | 10' | 16' |
| | 30' | 8' | 14' | 25' |
| 45° | 10' | 4' | 6' | 10' |
| | 20' | 6' | 10' | 17' |
| | 30' | 9' | 16' | 30' |
| 55° | 10' | 5' | 7' | 11' |
| | 20' | 8' | 13' | 20' |
| | 30' | 11' | 20' | 35' |
| 65° | 10' | 6' | 8' | 13' |
| | 20' | 11' | 16' | 25' |
| | 30' | 15' | 26' | 40' |

The diameter of the anchors is selected to permit them to be driven into the soil. Sufficient rigidity and stiffness is necessary for the anchors to be able to penetrate to the distances shown in Table 4. Only in soft or loose soils can depths of 10 to 20 feet be reached by hand driving with a maul. In other soils, or for greater depths, an impacting device, such as a compressed air operated paving breaker is required. Anchor diameters will typically be ¼" to 1" when pipes are being used and #3 (⅜") to #7 (¾") bars when reinforcing bars are being used.

What is claimed is:

1. A retaining system for stabilizing the potential slip zone of a slope which overlies a stable earth region comprising:

(a) a layer of geosynthetic fabric covering the potential slip zone of the slope; and (b) anchoring means for compressing the potential slip zone of the slope between said fabric layer and the underlying stable earth region, including:

(i) a plurality of anchoring rods driven through the potential slip zone of the slope into the underlying stable earth region;

(ii) said anchoring rods deployed in a substantially equally spaced array; and (iii) means for coupling said anchoring rods to said fabric layer whereby said anchoring rods extend from said layer of fabric into the underlying stable earth region and the potential slip zone of the slope is compressed between said fabric layer and the underlying stable earth region.

2. A retaining system according to claim 1 wherein said geosynthetic layer comprises geotextile material.

3. A retaining system according to claim 2 wherein the tensile strength of said geotextile material is at least 100 pounds per inch width and the weight of said geotextile material is at least 4.0 ounces per square yard.

4. A retaining system according to claim 1 wherein said geosynthetic layer comprises geogrid netting.

5. A retaining system according to claim 4 for stabilizing a slope wherein the slip zone of the slope comprises granular soil, the system wherein:

95% of the size of interstices of said geogrid netting is not greater than twice the particle size where 85% of the granular soil is finer and not greater than five times the particle size where 15% of the granular soil is finer.

6. A retaining system according to claim 4 for stabilizing a slope wherein the slip zone of said slope comprises soft cohesive soils, the system wherein:

95% of the size of the interstices of said geogrid netting is not greater than 0.15 mm.

7. A retaining system according to claim 4 for stabilizing a slope wherein the slip zone of said slope comprises medium cohesive soils, the system wherein:

95% of the size of the interstices of said geogrid netting is not greater than 0.25 mm.

8. A retaining system according to claim 4 for stabilizing a slope wherein the slip zone of said slope comprises hard cohesive soils, the system wherein:

95% of the size of the interstices of said geogrid netting is not greater than 0.84 mm.

9. A retaining system according to claim 4 further comprising:

a layer of geotextile material disposed beneath said layer of geogrid netting.

10. A retaining system according to claim 1 wherein said means for coupling said anchoring rods to said geosynthetic fabric layer comprises:

a plurality of grommets affixed to said fabric layer;

each said grommet disposed about one end of one of said anchoring rods;

washer means affixed to said end of each of said anchoring rod; and each said washer means engaging said respective grommet.

11. A retaining system according to claim 1 wherein said anchoring rods comprise a plurality of coupled rod segments.

12. A retaining system according to claim 1 wherein:

said layer of fabric comprises a plurality of adjacent panels of geosynthetic material;

said panels seamed together such that the strength of the seams is at least 90% of the tensile strength of said geofabric material.

13. A retaining system according to claim 1 further comprising:

a plurality of grommets;

said grommets affixed to said geofabric defining a substantially equally spaced network of anchoring points across said layer of geofabric; and said grommets comprising means for coupling said anchoring means to said layer of geofabric.

14. A retaining system according to claim 13 wherein:

said anchoring means comprises a plurality of anchoring rods, each associated with one of said grommets; and each said anchoring rod extending from said layer of fabric into the underlying stable earth region such that said layer of fabric is maintained in tensioned engagement with the potential slip zone of the slope.

15. A method for stabilizing the potential slip zone of a slope which overlies a stable earth region comprising:

(a) covering the surface of the slope with a layer of geosynthetic fabric; and (b) anchoring said geosynthetic fabric layer to said underlying stable earth region such that the potential slip zone of the slope is compressed between said geosynthetic fabric layer and the underlying stable earth region, including:

(i) affixing a plurality of grommets to said geosynthetic fabric to define a substantially equally spaced array of anchoring points for said geosynthetic fabric layer;

(ii) driving an anchoring rod through each said grommet and into the underlying stable earth region; and (iii) coupling each anchoring rod to said geosynthetic fabric layer at said respective grommets such that when said driving is completed said anchoring rods maintain said layer of geosynthetic fabric forcefully engaged with the surface of the slope whereby said potential slip zone of the slope is maintained in compression between said geosynthetic fabric layer and said underlying stable earth region.

16. A method for stabilizing a slope in accordance with claim 15 wherein:

the potential slip zone of said slope comprises granular soils; and said anchoring of said fabric layer causes compaction and subsequent densification of said granular soils.

17. A method for stabilizing a slope in accordance with claim 15 wherein:

the potential slip zone of the slope comprises cohesive soils; and said anchoring of said fabric layer causes consolidation of said cohesive soils.

18. A method for stabilizing a slope according to claim 15 wherein said covering of said slope with said layer of geofabric comprises:

deploying strips of adjacent geofabric material over said slope; and seaming said adjacent strips of geofabric material such that the strength of said seams are at least 90% of the tensile strength of said geofabric material.

19. A method for stabilizing a slope according to claim 15 further comprising:

seeding the slope before covering it with said geofabric.

20. A method for stabilizing a slope according to claim 15 further comprising:

employing geogrid netting as said geofabric; and seeding said slope after anchoring said geofabric layer.

* * * * *